US011441247B2

(12) United States Patent
Kunzmann

(10) Patent No.: US 11,441,247 B2
(45) Date of Patent: Sep. 13, 2022

(54) KNITTING METHOD

(71) Applicant: BekaertDeslee Innovation BVBA, Waregem (BE)

(72) Inventor: Andreas Kunzmann, Waregem (BE)

(73) Assignee: BekaertDeslee Innovation BVBA, Waregem (BE)

( * ) Notice: Subject to any disclaimer, the term of this patent is extended or adjusted under 35 U.S.C. 154(b) by 0 days.

(21) Appl. No.: 17/270,921

(22) PCT Filed: Aug. 27, 2019

(86) PCT No.: PCT/EP2019/072865
§ 371 (c)(1),
(2) Date: Feb. 24, 2021

(87) PCT Pub. No.: WO2020/043729
PCT Pub. Date: Mar. 5, 2021

(65) Prior Publication Data

US 2021/0189613 A1 Jun. 24, 2021

(30) Foreign Application Priority Data

Aug. 31, 2018 (EP) ..... 18192091
Mar. 15, 2019 (CN) ..... 201910196426.1

(51) Int. Cl.
*D04B 1/10* (2006.01)
*D04B 9/38* (2006.01)

(52) U.S. Cl.
CPC ..... *D04B 1/104* (2013.01); *D04B 9/38* (2013.01); *D10B 2403/023* (2013.01)

(58) Field of Classification Search
CPC . D04B 1/104; D04B 1/10; D04B 1/12; D04B 1/123; D04B 7/04; D04B 7/28; D04B 9/38; D04B 9/06; D04B 9/16
See application file for complete search history.

(56) References Cited

U.S. PATENT DOCUMENTS 2,108,925 A * 2/1938 Raynor ..... D04B 9/18 66/190
2,378,780 A * 6/1945 Lombardi ..... D04B 1/123 66/190
4,125,001 A * 11/1978 Bryars ..... D04B 1/04 66/190

(Continued)

FOREIGN PATENT DOCUMENTS

DE 102016005593 A1 11/2017
EP 3070192 A1 9/2016
JP S52-108377 U 8/1977

OTHER PUBLICATIONS

European Search Report pertaining to Application No. 18192091.9 dated Jan. 31, 2019 (9 pages).

(Continued)

*Primary Examiner* — Danny Worrell
(74) *Attorney, Agent, or Firm* — Dinsmore & Shohl, LLP

(57) ABSTRACT

The invention relates generally to a method for combining multiple knit constructions in a single fabric using a double selection circular knitting machine. It is in particular directed of seamlessly combining in a single fabric an air circulating construction with a double-knit construction. It further provides a fabric obtained using the method of the present invention.

10 Claims, 2 Drawing Sheets

(56) References Cited

U.S. PATENT DOCUMENTS

| | | | | | |
|---|---|---|---|---|---|
| RE30,638 | E * | 6/1981 | Bryars | D04B 9/16 | 66/191 |
| 5,299,435 | A * | 4/1994 | Whalley | D04B 1/123 | 66/61 |
| 6,151,922 | A * | 11/2000 | Shimasaki | D04B 1/18 | 66/61 |
| 6,622,528 | B2 * | 9/2003 | Masse | D04B 9/28 | 66/196 |
| 7,878,528 | B2 * | 2/2011 | Dorn | B60R 21/216 | 280/728.3 |
| 9,644,291 | B1 * | 5/2017 | Kuo | D04B 1/14 | |
| 9,732,451 | B2 * | 8/2017 | Lee | D04B 15/02 | |
| 10,174,445 | B2 * | 1/2019 | Brunton | D04B 1/123 | |
| 10,626,529 | B2 * | 4/2020 | Brunton | D04B 1/123 | |
| 10,753,018 | B2 * | 8/2020 | Kuo | D04B 15/90 | |
| 2017/0130376 | A1 | 5/2017 | Brunton et al. | | |
| 2017/0211214 | A1 | 7/2017 | Kuo | | |
| 2021/0189613 | A1 * | 6/2021 | Kunzmann | D04B 1/102 | |

OTHER PUBLICATIONS

Search Report and Written Opinion pertaining to Application No. PCT/EP2019/072865 dated Oct. 31, 2019 (14 pages).

* cited by examiner

KNITTING METHOD

CROSS REFERENCES TO RELATED APPLICATIONS

This application is a national-stage application under 35 U.S.C. § 371 of International Application No. PCT/EP2019/072865, filed Aug. 27, 2019, which claims the benefit of priority to Chinese Patent Application No. 201910196426.1, filed Mar. 15, 2019, and to European Patent Application No. 18192091.9, filed Aug. 31, 2018.

The invention relates generally to a method for combining multiple knit constructions in a single fabric using a double selection circular knitting machine. It is in particular directed of seamlessly combining in a single fabric an air circulating construction with a double-knit construction. It further provides a fabric obtained using the method of the present invention.

BACKGROUND OF THE INVENTION

A double jersey knit fabric (also called a double jersey knit wear) is a classical knit fabric that is knitted on a circular knitting machine, whereby the circular knitting machine is provided with a cylinder and a dial (that is positioned just above the cylinder), each provided with needles, the needles of the cylinder typically being provided for knitting the front of the fabric, and the needles of the dial typically being provided for knitting the back of the fabric. Usually, but not mandatory, lay-in yarns are added in-between the dial and the cylinder in order to give volume to these double jersey knit wears, this for instance when it is used as mattress ticking.

In a double selection circular knitting machine, the needles of the cylinder and the dial are independently driven by an electronical pattern mechanism, through which every single needle of the cylinder/dial can be selected to either knit, miss or tuck, thereby creating the possibility to produce a design on the front and the back of the fabric.

Such double selection circular knitting machines are commercially available from, for example the Monarch Knitting Machinery Corporation (US), Terrot Gmbh (DE), Santoni S. p. A (IT), and others.

Where these machines are capable of producing different knit constructions such as a spacer knit, a double knit, a mesh knit, a single jersey knit, and others, one often has to combine two or more knitted fabrics in the final product in order to obtain a fabric wherein one portion has a first knit construction and another portion has another knit construction. Here these different portions will be joined by way of a seam (e.g. sewing, welding, and gluing).

In many applications, seams and transfer zones can be source of physical discomfort and/or aesthetically unpleasant. At the connection zones the fabrics are typically less strong and for example prune to laddering. Also, such a fabric is limited in the possibilities in design and doesn't allow an integrated border zone in case of mattress ticking.

Examples of such prior manufacturing methods can for example be found in D1 (US2017/211214) disclosing a weft knitted fabric comprising fabrics (310, 320) making up the outer layers and the presence of a lay-in or filler yarn (110) but fails to provide a further connection yarns and the filler yarn is always floating between the layers. With such construction the possibility of seamless joining an air circulating construction with a double-knit construction by grouping of the lay-in or filler yarn in the air circulating construction through this additional connection yarn is not possible. A similar situation exists in US2017/0130376 where the lay-in yarn is floating between the layers and the further yarn on feeders 3 or 6 is only knitted to the front and fails to act as a connection yarn grouping the lay-in yarn by tuck or tuck/mis combination. As such this reference equally fails to disclose the combination of an air circulating construction with a double-knit construction as can be derived from the title and abstract of this specification wherein it is stated that the therein disclosed method results in a 'tight' 'woven fabric-like' knitting structure. Also in JPS52108377 the in-lay yarn (6) is floating between the layers and not grouped by tuck or tuck/miss combination of a connection yarn.

It is accordingly an object of the present invention to provide a method for combining in a single fabric on a double selection circular knitting machine an air circulating construction with a double knit construction with full control of the lay-inn yarn throughout the fabric by means of a connection yarn and how it is being combined with the other elements of the fabric in both the air circulating construction and the double knit construction throughout the fabric. It is to be understood, that within the context of the invention further constructions may be present within the final product, but comprises at least an air circulating construction with a double knit construction.

These and other aspects of the present invention will become apparent to those skilled in the art after a reading of the following description of the preferred embodiment when considered with the drawings.

DETAILED DESCRIPTION OF THE INVENTION

In the following detailed description, a method for combining multiple knit constructions in a single fabric on a standard double selection knitting machine, will be further clarified. The intention of this description is only to further explain the general principles of the present invention, therefore nothing in this description may be interpreted as being a restriction of the field of application of the present invention or of the patent rights demanded for in the claims.

In the event that any of the terms used in the description and/or claims are conflicting in whole or in part, the broadest definition is intended to be used for the purposes of this application for the present invention.

Referring now to the attached figures, and providing exemplary parts of knitting patterns of knit fabrics according to the invention a circle downwards (2) is a stitch, typically on the cylinder, while a circle upwards (3) is a stitch, typically on the dial. It is also possible to have tucks (4) instead of stitches represented as a downward V in the line representing the yarns. In the areas where the lines shown no tucks or stitches the yarn is floating between the outer layers, i.e. between the front and the back layer of the fabric. When in a zone only on the needles of the cylinder (C) or the dial (D) is knitted, a blister fabric (also called a single jersey fabric) is formed.

Figure 1:
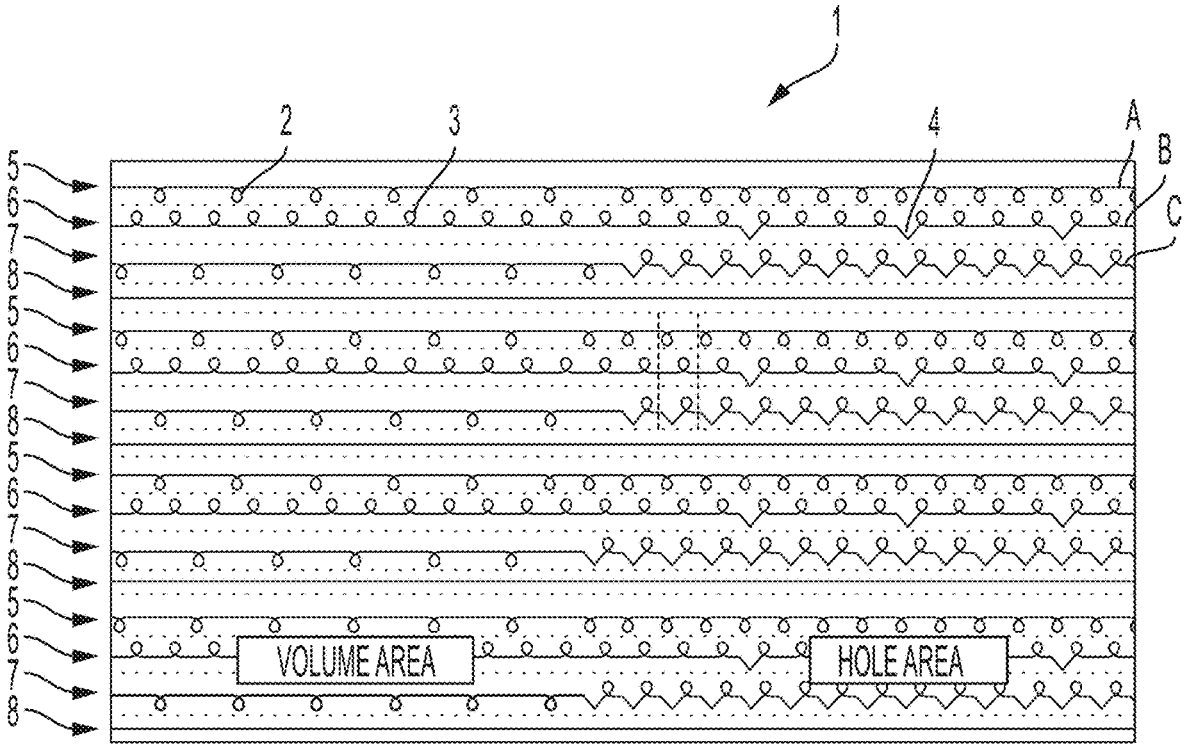
FIG. 1 a part of a row of a knitting pattern of an exemplary embodiment of a knit fabric according to the invention that is knitted on a double selection circular knitting machine, and wherein the knit fabric is build up out of 3 yarns.

A part of the rows of a knitting pattern of an exemplary embodiment of knit fabric (1) according to the invention is shown in FIG. 1. In this fabric a double-knit construction is combined with an air circulating construction knitted on double selection circular knitting machine, and making use of 4 yarns (5, 6, 7 and 8).

The needle pattern (A) of the first yarn (5) is set by means of a first selection of needles, in the shown example on the Cylinder of the machine, and making up the first outer face, in the shown example the back, of the fabric and creating a blister fabric throughout the fabric, i.e. both in the double knit construction and the air circulating construction;

The needle pattern (B) of the second yarn (6) is set by means of a second selection of needles, in the shown example on the dial of the machine, and making up the second outer face, in the shown example the front, of the fabric and creating a blister fabric in the double knit construction with tuck connections in the air circulating construction;

The pattern of a third yarn (7) herein also referred to as a connection or tuck yarn is controlled by a third selection of needles (C) present on both the cylinder and the dial of the machine, thus connecting the outer layers of the fabric by means of tucks in the air circulating area whilst mainly floating or only being connected to one of the outer layers, in the example to the back, in the double knit construction;

The fourth yarn (8) (not shown) is a fill-in or inlay yarn introduced in between the two outer layers of the fabric, both in the double knit construction as in the air circulating construction.

Evidently and as is apparent from the foregoing figure, the needle pattern for each of said yarns is controlled by an independent pattern controlling mechanism, represented as systems A-C in FIG. 1. In principle any art known pattern controlling system can be used within the context of the present invention in as far said system is capable of controlling both the needles of the cylinder (C) as well as the needles of the dial (D).

Figure 2:
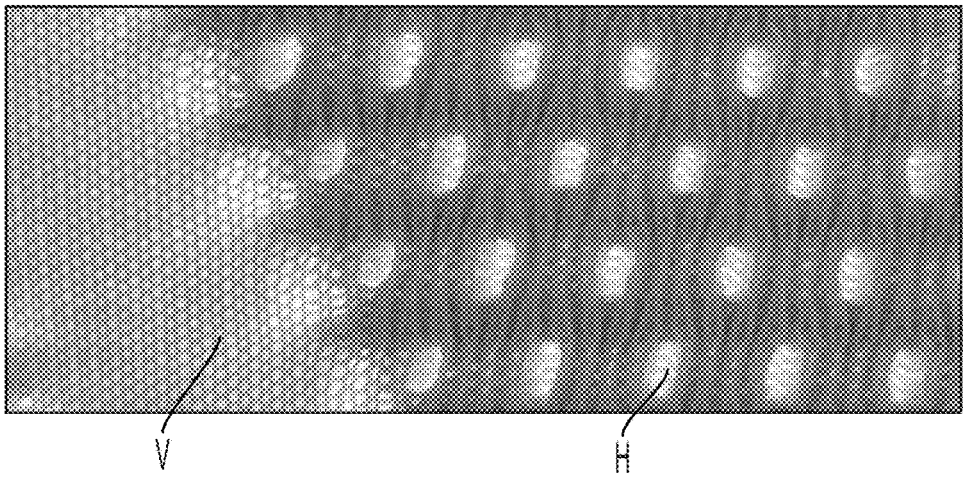
FIG. 2 Detailed picture of the top view of a fabric made according to the knitting pattern of FIG. 1. On the left hand side this fabric shows a voluminous double knit—the Volume Area (V), which seamlessly turns into the air ventilation zone—the Hole Area (H).

Characterizing for the method according to the invention and as mentioned above, is the introduction of the fill-in or inlay yarn across the fabric, i.e. in both the double-knit construction as well as in the air circulating construction. Normally in this kind of air circulating constructions a fill-in or inlay yarn will be absent, making its combined manufacture in a single fabric difficult to achieve. In the method of the present invention this problem is resolved by means of the connection or tuck yarn, grouping by means of the pattern of tucks the fill-in yarn in the air circulating fabric and thus controlling the desired breathability of this construction. As shown in FIG. 2 the pattern of the tuck yarn can group the fill-in yarn creating the visible 'ventilation' holes, but in other zones the tuck yarn will connect the outer layers and group the inlay yarn without creating such a high air ventilation area.

It is accordingly a first objective of the present invention to provide a method to combine on a double selection circular knitting machine in a single fabric having a first and a second outer layer, an air circulating construction which connect the outer layers combined with a double-knit construction, said method comprising;

a first selection of needles for knitting the first outer layer of the fabric;

a second selection of needles for knitting the second outer layer of the fabric;

a third selection of needles to introduce a connection yarn into the fabric and adding a lay-in or filler yarn in between the two outer layers of the fabric, said method being characterized in that the connection yarn is connecting the outer layers in the air circulating construction and floating and/or knitted to only one of the outer layers in the double-knit construction; and in that the lay-in yarn is lying loose between the outer layers in the double-knit construction and grouped by tuck or tuck/miss combinations through the connection yarn in the air circulating construction.

Within this method there is no particular orientation for the selection of the needles. In the example of FIG. 1, the first selection of needles is set on the dial of the machine and creates the front of the fabric, but within the context of the invention, a first selection of needles could equally be set on the cylinder, thus creating the back of the fabric.

The same applies for the second, and third set of needles. In the example of FIG. 1, the second selection of needles is set on the cylinder and creates the back of the fabric, but within the context of this invention, such second selection of needles could equally be set on the dial, thus creating the front of the fabric.

As mentioned before the selection of the needles for each of the yarns is set by the pattern of tuck/miss/knit and/or tuck/miss or knit/miss combinations for the needles. Being in the possibility of controlling the pattern of the needles, a seamless pattern of the different knit constructions, can be created throughout the fabric, and at either side. Expressed differently, the selection of the needles for each of the yarns in making a knit, tuck or miss is set by the design one would like to achieve, wherein the needle pattern of the dial can also be created on the cylinder, and vice versa.

Given the selection by design of the needles controlling the tuck yarn, said tuck yarn not only connecting outer layers of the fabric but equally controlling the positioning and/or grouping of the fill-in yarn(s), enables to create a seamless inlay design across the fabric, for example for decorative purposes (e.g. fabric integrated embossed branding), or to create zones where for example extra support or extra ventilation may be required.

Thus in one aspect of the invention the method is further characterized in that the positioning and/or grouping, i.e. in that the design of the fill-in or inlay yarn(s) is controlled by the design, i.e. the selection of needles of the tuck or connection yarn. In a particular embodiment the inlay or fill-in yarn is lying loose in double-knit construction and grouped by the design of the tuck or connection yarn in the air circulating construction.

In the example of FIG. 1, only one tuck or connection yarn is being used. By choosing a tuck or connection yarn with a different colour than the yarn(s) used in preparing the outer layers of the fabric, one can change the colour appearance between the knit constructions. In a double-knit construction the tuck or connection yarn can be floating between the layers or is being connected to one or both of the outer layers. When creating a voluminous double knit construction, the tuck or connection yarn can be floating between the layers or is being connected to only one of the outer layers, preferably to the back of the fabric. When floating between the layers the tuck or connection yarn is visually hidden or at least obscured by the inlay or fill-in yarn. As such it may have no impact, or at least an uncontrollable impact on the colour appearance of this part of the double knit, when compared to the air ventilation constructions wherein it is being tucked and connecting the outer layers. In these areas its colour will shine through, thus changing the colour appearance of the fabric in said air ventilation construction. When connected to the back layer the tuck or connection yarn is visually hidden from the front layer. As such it has no impact on the colour appearance of this part of the double knit, when compared to the air ventilation constructions wherein it is being tucked and connecting the outer layers. In these areas its colour will shine through, thus changing the colour appearance of the fabric in said air ventilation construction. Hence, using the method of the invention a multi-coloured fabric can be achieved.

Instead of a single tuck or connection yarn, more than one tuck or connection yarn can be used in the method of the invention. Thus in a further embodiment the present invention provides a method to combine on a double selection circular knitting machine in a single fabric having a first and a second outer layer, an air circulating construction which connect the outer layers combined with a double-knit construction, said method comprising;

- a first selection of needles for knitting the first outer layer of the fabric;
- a second selection of needles for knitting the second outer layer of the fabric;
- a third selection of needles to introduce one or more connection yarn(s) into the fabric and
- adding a lay-in or filler yarn in between the two outer layers of the fabric, said method being characterized in that
- the connection yarn(s) is/are connecting the outer layers in the air circulating construction and floating and/or knitted to only one of the outer layers in the double-knit construction; and in that
- the lay-in yarn is lying loose between the outer layers in the double-knit construction and grouped by tuck or tuck/miss combinations through the connection yarn(s) in the air circulating construction.

It will be apparent to the skilled artisan, that by choosing different colours of yarns, multi-coloured fabrics can be achieved.

Figure 3:
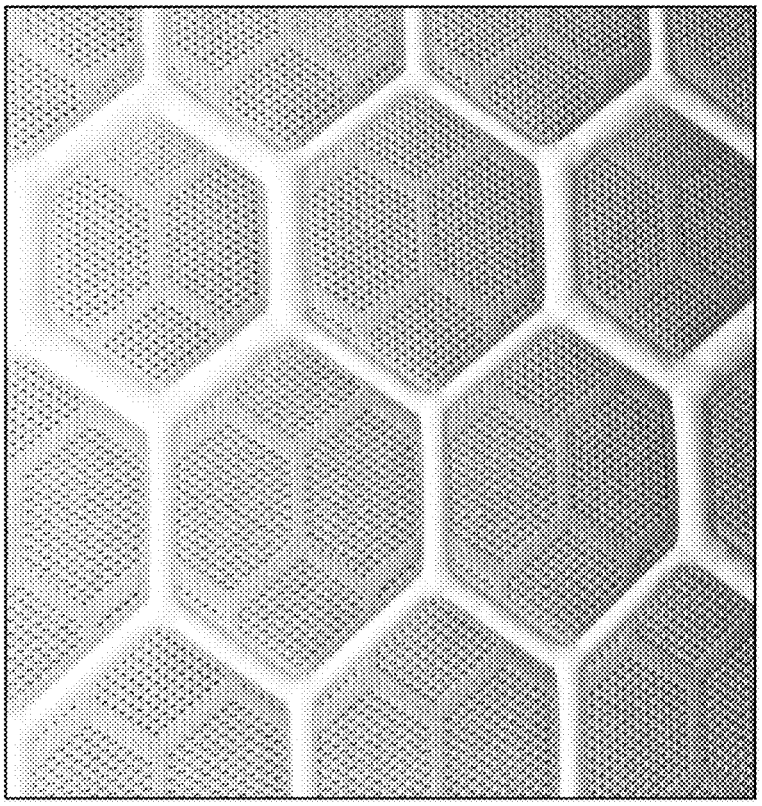
FIG. 3 another example of a fabric made using the method of the invention showing air ventilation zones (areas with the hole structure) and a 'voluminous' double knit pattern.
Figure 4:
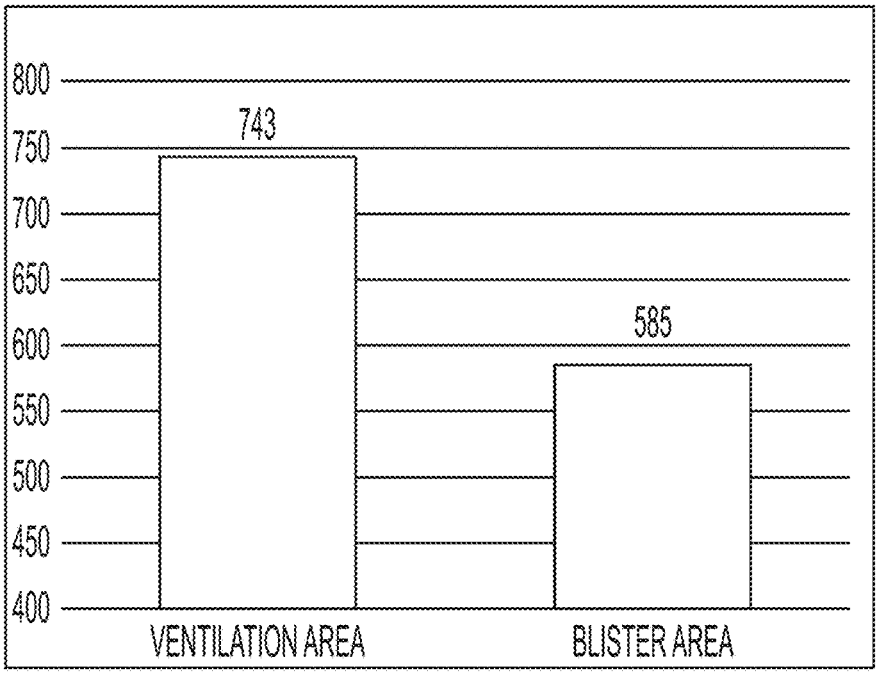
FIG. 4 Breathability comparison of an air circulating construction (Ventilation area) and a double knit construction (Blister area) present in a fabric according to the invention, based on ISO test ISO-9237 (1995) at 20° C., a relative humidity of 65%, a gauge surface of 20 $cm^2$ and with an underpressure of 1 mbar. Results are expressed in $l/(m^2 \cdot s)$ wherein a higher value represents a better breathability.

FIGS. 2 and 3 provides examples of fabrics that can be achieved using the method of the invention and nicely shows the shine through of the coloured connection yarn in the air ventilation area (V). The holes in this ventilation area are defined by the designer, i.e. by the tucks in the second selection of needles and by the tucks in the selection of needles for the tuck or connection yarn. In this ventilation area eventual inlay yarns are bound together through the tucks of the connection yarn, such that no filling yarns lay inside the 'ventilation' holes, which improves ventilation of the fabric. Whilst in the white double-knit construction the area is filed with filling yarn and gives a voluminous feel—the voluminous area (V). In FIG. 3 extra added are additional colours (i.e. additional tuck yarns) to create blister or deep effect. For the volume the inlay yarn can go from 150 DEN to 2400 DEN. The back of the fabric can be an FR yarn, in this example comprising a stretch yarn, i.e. a PESDOR stretch yarn to provide extra loft and stretch.

It follows from these examples that in one embodiment of the invention the tuck yarn(s) are connecting the outer layers by means of tuck/miss combinations in the air circulating construction. In another embodiment the connection yarn is grouping the fill-in or inlay yarn by means of tuck combinations in the air circulating construction; preferably such that no filling yarns lay inside the 'ventilation' holes.

As mentioned herein before, in the double knit constructions that can be present within the fabric, the tuck yarn can connect both layers and group the filling yarn without creating the aforementioned air circulating zone, or it is floating between the layers or only connected to the back to create a voluminous double knit.

A method according to the invention is particularly useful in the manufacture of a knitted mattress ticking, with certain advantages for such product in providing;

- no sewing or connection zones typically creating discomfort to the user and accordingly with a smoother touch;
- Sewing also limits on the zones one can combine in a certain direction, no such limitations exists using the methods of the invention, yielding an almost unrestricted creativity for the designer with even the possibility of embossing logo's or trade names into the fabric;
- strength since being made in a single process;
- no limitations in the design that can be extended to the border zone, and being directly integrated in the mattress ticking;
- strongly reduced curling because the inlay material is evenly distributed between the front and the back of the fabric;
- wash ability at higher temperatures without affecting the structure;
- lifting the need of sewing the methods of the present invention greatly reduce the processing time in creating a fabric with different constructions;
- high breathability for a heavy fabric with an inlay across the fabric as evident from the comparison shown in FIG. 3.

In said experiment we are comparing zones of the XCITE fabric showing that we can achieve areas with different permeability.

This method according to the invention is particularly suitable for knitting double jersey mattress ticking, but equally useful in the manufacture of upholstery or garments such as shoe ware, sportswear or other garments.

The invention claimed is:

1. A method to combine on a double selection circular knitting machine, in a single fabric having a first outer layer and a second outer layer, an air circulating construction that connects the outer layers combined with a double-knit construction, the air circulating construction comprising ventilation holes, the method comprising:

- knitting the first outer layer of the fabric with a first yarn by means of a first selection of needles;
- knitting the second outer layer of the fabric with a second yarn by means of a second selection of needles;
- introducing a connection yarn into the fabric with a third selection of needles; and
- adding a lay-in yarn or a filler yarn between the first outer layer and the second outer layer, wherein:

the connection yarn connects the outer layers in the air circulating construction and floats and/or is knitted to only one of the outer layers in the double-knit construction; and the lay-in yarn or the filler yarn lies loose between the outer layers in the double-knit construction and is grouped through the connection yarn in the air circulating construction by tuck or tuck/miss combinations, such that no lay-in yarns or filler yarns lay inside the ventilation holes of the air circulating construction.

2. The method according to claim 1, wherein, in the air circulating construction, the lay-in yarn or filler yarn is positioned or grouped by the selection of needles of the connecting yarn.

3. The method according to claim 1, wherein, in the air circulating construction, the connection yarn floats between the first outer layer and the second outer layer in the double-knit construction and connects the outer layers by tuck/miss combinations.

4. The method according to claim 1, wherein the fabric is a knitted mattress ticking.

5. A double jersey knit fabric knitted by the method according to claim 1, the double jersey knit fabric comprising:

a first outer layer;

a second outer layer;

an air circulating construction that connects the first outer layer and the second outer layer combined with a double-knit construction; and a connection yarn and a lay-in yarn or a filler yarn between the first outer layer and the second outer layer of the fabric, wherein:

the air circulating construction comprises ventilation holes;

the connection yarn connects the first outer layer and the second outer layer in the air circulating construction and floats and/or is knitted to only one of the outer layers in the double-knit construction; and the lay-in yarn or the filler yarn lies loose between the first outer layer and the second outer layer in the double-knit construction and is grouped through the connection yarn in the air circulating construction by tuck or tuck/miss combinations, such that no lay-in yarns or filler yarns lay inside the ventilation holes of the air circulating construction.

6. The double jersey knit fabric of claim 5, wherein the fabric is a knitted mattress ticking.

7. The double jersey knit fabric of claim 5, wherein, in the air circulating construction, the lay-in yarn or the filler yarn is positioned or grouped by the selection of needles of the connecting yarn.

8. The double jersey knit fabric of claim 7, wherein the fabric is a knitted mattress ticking.

9. The double jersey knit fabric of claim 5, wherein the connection yarn floats between the outer layers in the double-knit construction.

10. The double jersey knit fabric of claim 9, wherein the fabric is a knitted mattress ticking.

* * * * *